US005167516A

United States Patent [19]

Tan et al.

[11] Patent Number: 5,167,516

[45] Date of Patent: Dec. 1, 1992

[54] CONNECTION WITH FLOATING SHIELD

[75] Inventors: Haw-Chan Tan, Diamond Bar; Nobbert Yu, Culver; Renee Chiang, Long Beach, all of Calif.

[73] Assignee: Foxconn International, Inc., Sunnyvale, Calif.

[21] Appl. No.: 748,110

[22] Filed: Aug. 21, 1991

[51] Int. Cl.[5] ..... H01R 13/453

[52] U.S. Cl. ..... 439/141; 439/140

[58] Field of Search ..... 439/140, 141, 607-610, 439/931

[56] References Cited

U.S. PATENT DOCUMENTS

| | | | |
|---|---|---|---|
| 4,445,739 | 5/1984 | Wooten | 339/42 |
| 4,580,862 | 4/1986 | Johnson | 339/64 R |
| 4,697,859 | 10/1987 | Fisher, Jr. | 439/246 |
| 4,787,706 | 11/1988 | Cannon, Jr. et al. | 350/96.20 |
| 4,832,613 | 5/1989 | Tsukakoshi | 439/141 |
| 4,871,320 | 10/1989 | Mouissie | 439/78 |
| 4,992,054 | 2/1991 | Cassan | 439/76 |

FOREIGN PATENT DOCUMENTS

| | | | |
|---|---|---|---|
| 344850 | 12/1989 | European Pat. Off. | 439/141 |
| 660645 | 5/1938 | Fed. Rep. of Germany | 439/140 |

*Primary Examiner*—Neil Abrams

[57] ABSTRACT

An electrical male connector assembly incorporates a floating shield that is resiliently held in a position on the connector body wherein the male contact pins are hidden or shielded from contact by the shield in its outermost position. When the connector member is mated with a corresponding female connector, the opposed face of the female connector impinges on the shield and cause it to be slid along the contact pins to a retracted position. Means are provided for biasing the shield toward its outermost position. The shield face is metalized to provide an exposed ground plane in electrically conductive contact with a metal portion of the connector member shell to drain off any electrical static discharges that might otherwise come into contact with the exposed contact pins.

16 Claims, 4 Drawing Sheets

CONNECTION WITH FLOATING SHIELD

BACKGROUND OF THE INVENTION

1. Field of The Invention

The present invention relates to a spacer of a connector, and particularly to a floating shield for a male connector member capable of aligning the contacts in place and protecting the contacts when in the un-mated situation.

2. The Prior Art

As disclosed in U.S. Pat No. 4,722,022 entitled "Shielded Line Terminator Enclosure", Pat. No. 4,895,535 entitled "Keyed Mountable Electrical Connectors", and Pat No. 4,854,890 entitled "Shielded Electrical Connector", the front portions of the contact pins are generally exposed on the front portion of a male connector member in order to be individually inserted into the corresponding female contact sockets embedded within the corresponding apertures of a mating female connector member. It is also known that almost all D-Sub type connectors have the same structure. A typical male D-Sub connector includes an insulator covered by a shell and having a plurality of passageways to receive a number of corresponding male contacts therein, wherein the front portion of each male contact protrudes out of the insulator and is exposed within the recess formed by the flange portion of the shell receiving the corresponding projection portion of the mating female connector member. Through the main figure of U.S. Pat. No. 4,854,890, the structural relationship between the male and female connector members is made obvious. In this instance, it is obvious that the exposed contacts are inserted into the corresponding apertures of the female connector in order to mate the male and female contacts. In this situation, the recess formed by the flange can receive the projection portion of the female connector without any interference. So far as is known, this type combination is applied to all prior art connector assemblies.

It is noted that high density, i.e. more than two rows and less distance between adjacent contacts, and miniaturization are the trends for connector design to comply with the requirements of computer system. In prior art connectors, the size of the contact may be reduced to accomplish a high density or a miniature design. In this circumstances, the strength of the contact pin is less than usual and subject to bend out of proper position, due to the effect of external forces during handling and storing, applied on its exposed portion in an un-mated condition. Using a more rigid material to replace the usual type to prevent the contact's tilting is more expensive than using the original, is not easy to manufacture and will speed wearing of the mold so as to require renewal of the mold more frequently. Otherwise, it is frequently required to properly align the male contact pins before coupling the male and female connectors. This process is troublesome for a computer user, especially when adequate tools are unavailable.

Another problem is presented by the process of inserting the male contact into the female contact. Because the front portion of the male contact extends forwardly from the insulator as a cantilever, the support point of the contact pin is at its roof where it emerges from insulator, and is spaced far from the exposed distal end of the contact. A significant bending moment may be applied to the male contact when the distal end of the male contact engages the female contact during insertion. Using a strong material to enhance the strength of the contact pin has heretofore been the only way to avoid the deformation or breakage of the male contact pins.

Another problem is presented that because the dimensions are so small that the tolerances are tight for the small contact. The higher precision requirement will make it difficult to fabricate the product, or an expensive material must be used in place of the common one to maintain the quality control.

Also, another problem is the possibility of damage from electrical static discharge (ESD) by any inadvertent touch through hand or tool to the exposed contacts during its un-mated condition.

Thus, there has been a need for a male connector having design characteristics to overcome the potential disadvantages when a high density type connector is required. The present invention is a preferred way to meet this need.

To overcome the foregoing disadvantages of the prior art male connector, it is an object of the present invention to provide a male connector which accommodates high density type connector design.

Another main object of the invention is to provide a male connector member having a shield which can protect and cover the male contacts of the male connector when in un-mated condition, and which be displaced to expose the male contacts for mating with the female contacts when in mated situation.

Yet another object of the invention is to provide a male connector member which does not require contact pin adjustment or alignment before mating with the female connector.

A still further object of the invention is to provide a male connector member which can use a soft and common material for its contacts to minimize expense and complicated tools.

Another object of the invention is to provide a male connector member in which the contacts are supported against bending during mating.

Still another object of the invention is to provide a connector which allows a broad tolerance range for manufacturing.

Yet another object of the invention is to provide a male connector member which diminishes the possibility of ESD damage due to external contact through hands or tools.

SUMMARY OF THE INVENTION

In terms of broad inclusion, the male connector member of the invention incorporates a floating shield that in one aspect of the invention is resiliently held in a position on the connector body wherein the male contact pins are hidden or shielded from contact by the shield in its outermost position. When the connector member is mated with a corresponding female connector, the opposed face of the female connector impinges on the shield and causes it to be slid along the contact pins to a retracted position. Means are provided for biasing the shield toward its outermost position. In another aspect of the invention, the shield face is metalized to provide an exposed ground plane in electrically conductive contact with a metal portion of the connector member shell to drain off any electrical static that might otherwise come into contact with the exposed contact pins.

The invention, together with further objects and attendant advantages, will be best understood with reference to the following detailed description taken in conjunction with the accompanying drawings. It is to be understood however that the invention is not limited to the embodiment described and illustrated since it may be embodied in various forms within the scope of the appended claims.

DESCRIPTION OF THE PREFERRED EMBODIMENT

Figure 1:
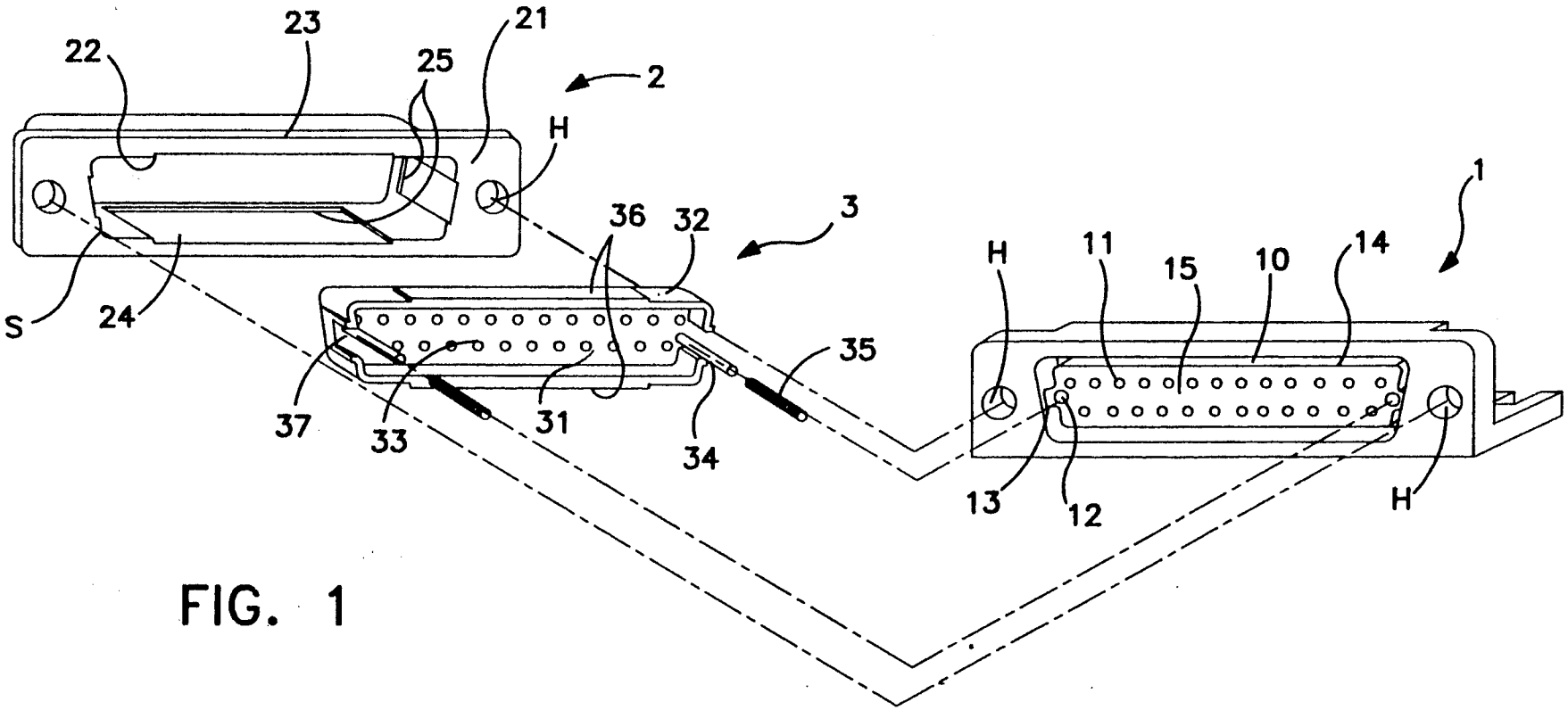
FIG. 1 is an exploded perspective view of a presently preferred embodiment of a connector with a floating shield according to this invention.
Figure 2B:
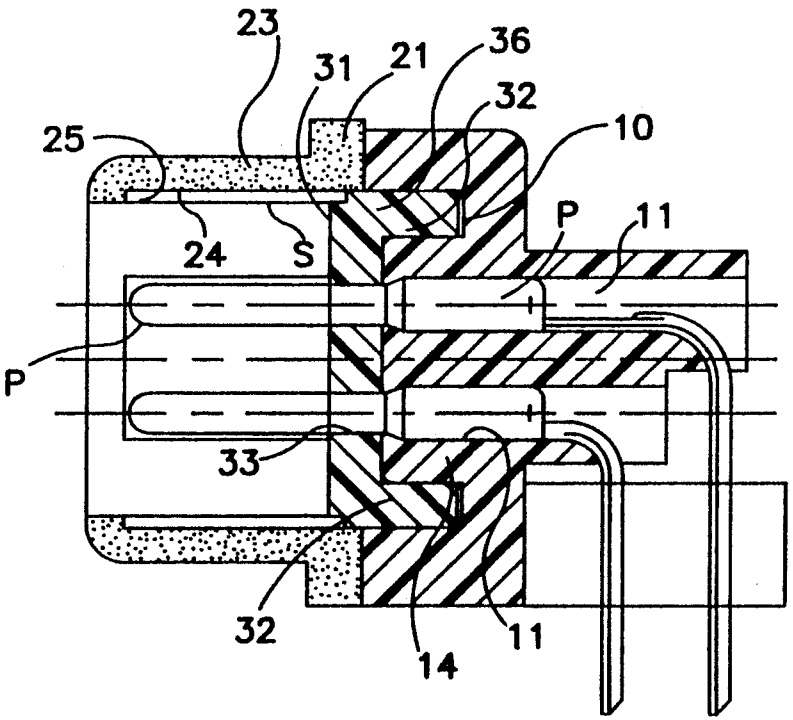
FIG. 2(B) is a vertical cross-sectional view of the assembled connector in mated condition.
Figure 2A:
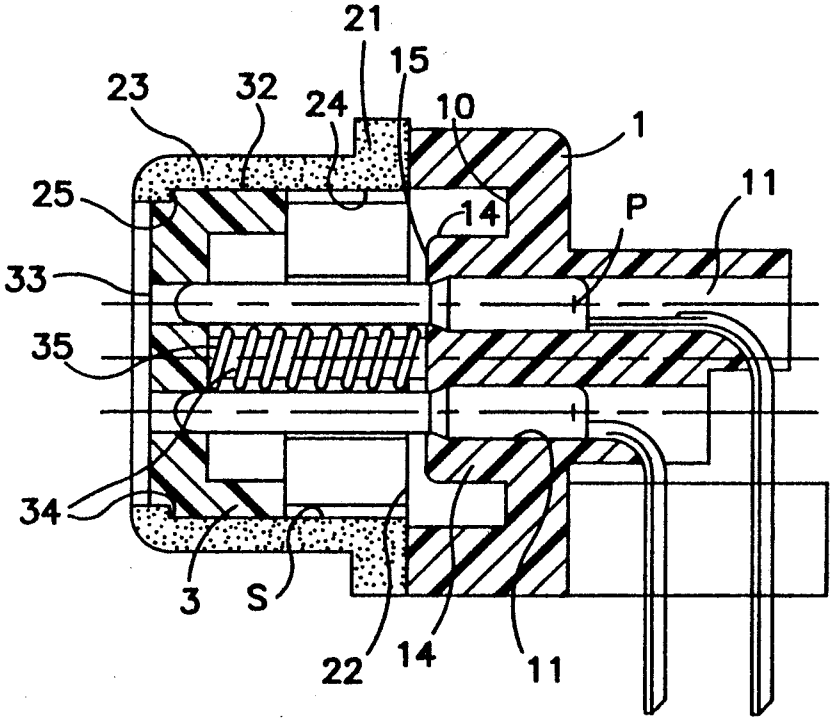
FIG. 2(A) is a side vertical cross-sectional view of the assembled connector of FIG. 1 shown in un-mated condition.
Figure 3B:
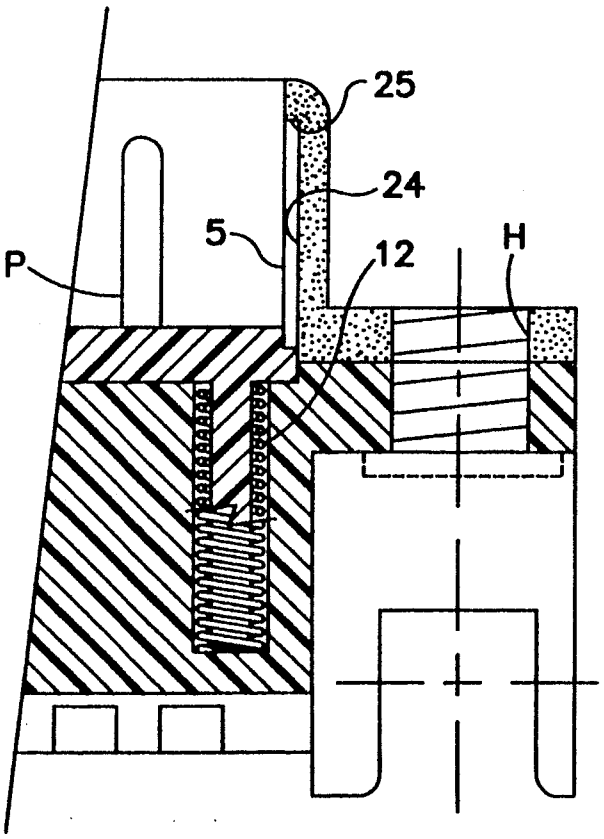
FIG. 3(B) illustrates the assembly of FIG. 3(A) in mated condition.
Figure 3A:
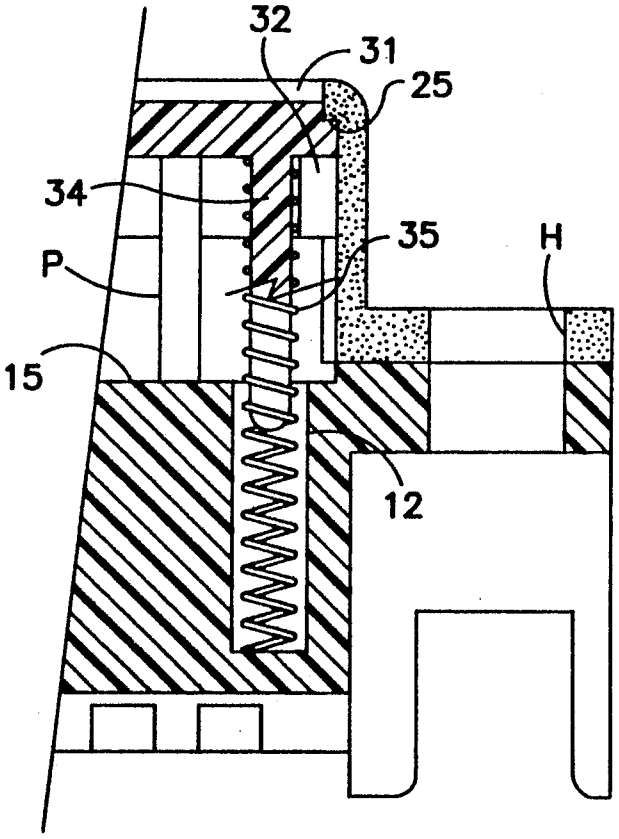
FIG. 3(A) is a fragmentary horizontal cross-sectional view of the assembled connector of FIG. 1 in un-mated condition.

Referring to FIG. 1, the subject male connector member includes an insulator or housing 1 having a plurality of passageways 11 extending therethrough within each of which a male contact P (FIGS. 2A-3B) is positioned. A metal shell 2 includes a plate 21 adapted to be mounted on the front surface of the insulator 1. An opening 22 on the center portion of the shell and a flange 23 surrounding the edge of the opening 22 define a recess S. A floating shield 3 is disposed within the recess S, having a base 31 conformable to the opening 22 of the shell 2, and defining therethrough a plurality of apertures 33 individually corresponding to the passageways 11 of the insulator 1 for receiving the contact P. Four side walls 32 extend backwardly from the circumferential edge of the base 31. Referring to FIGS. 2(A) and 2(B), to receive the side walls 32 of the movable shield 3, a groove 10 surrounds the passageways portion 14 and extends inwardly from the front surface 15 of the insulator 1 as shown. A pair of posts 34 each positioned near opposite ends of the shield extend backwardly for a substantially longer distance than side walls 32 of the shield. To correspond with these posts, there is provided a pair of holes 12 appropriately positioned in the insulator 1. Referring to FIGS. 3(A) and 3(B), a pair of helical spring 35 are provided, each respectively disposed intermediate the post 34 and the corresponding hole 12 so that one end of the spring 35 surrounds the associated post 34 and the other end of the spring 35 is received in the corresponding hole 12.

To enhance the stability and smooth of the shield's floating movement, the four outside corner portions of the shield 3 are reduced inwardly so the middle portion 36 of each outside side wall 32 extends outwardly a little. The flange 23 of the shell 2 and the recess S has corresponding accommodating portions 24 extending in the same direction so as to be conformable to the corresponding portions 36 of the side walls 32. Each of these corresponding portions 24 terminates near the front end of the flange 23 to form a step or shoulder 25 for stopping the further outward movement of the shield 3.

The slots 37 formed in each end of the shield 3 (FIG. 1), extend from the outer edge of each of two longitudinally opposite side walls 32 into the base 31. A pair of protrusions 13 are positioned at the two longitudinally opposite ends of the passageways portion 14 of insulator 1 to be inserted into the slot 37 during mating. Clamp screw holes H are positioned at the two opposite ends of the insulator 1 and of the shell 2 as shown to receive appropriate clamp screws (not shown).

When assembling, referring to FIGS. 2(A) and 3(A), the shell 2 and the insulator 1 are aligned combined together through a pair of clamp screws extending through the corresponding screw holes H. The contacts P previously mounted in the passageways 11 of the insulator 1, extend through the corresponding aligning apertures 33 of the shield 3. The springs 35 are compressed somewhat (FIG. 3A) so that one end abuts against the base 31 of the shield 3, and the other end abuts against the inner end of the hole 12 of the insulator 1. In this condition, the shield 3 is resiliently biased forwardly by the springs 35 surrounding the posts 34 so that the front ends of the middle portions 36 of the side walls 32 abut against the steps 25 of the flange 23 (FIG. 2A). The shield 3 is positioned on the front portion of the recess S and held by the shell 2. The contacts P are hidden behind the "floating" shield 3 and the tips of the contacts are not exposed outside but retained within the apertures 33 of the shield 3. The above description referring to FIGS. 2(A) and 3(A) describes in the unmated condition of the connector.

Referring to FIGS. 2B and 3B, when mated, the insulator front portion of the female connector associated with its shell flange is inserted into the recess S, so the shield 3 of the male connector is pushed backwardly by the insulator front portion of the engaging female connector to expose the male contacts for mating with the female contacts until the side walls 32 of the shield 3 inhabit the groove 10 of the insulator 1, and the base surface 31 butts against the front surface 15 of the insulator 1. During the process, the front portion of each male contact P is gradually exposed due to the backward movement of the shield 3, but is immediately received within the corresponding female contact inset in its passageway of the female connector insulator. In this condition (FIG. 3B), the spring 35 is compressed, and the post 34 is totally inserted within the hole 12 of the insulator 1. Also, the protrusion 13 of the insulator 1 is sandwiched within the slot 37 of the shield 3.

It should be noted that in the un-mated condition (FIGS. 2A and 3A), the shield 3 is resiliently biased by the springs to its outermost position and serves to ensure the right positioning of each male contact at its mating end. This ensures that the tip of the male contact P will be guided to its right position during mating. In other words each male contact will be exactly inserted into its corresponding female contact of the complementary female connector. There is no necessity to spend time in adjusting the position of or aligning the end of the male contact before mating. In the prior art, the male contacts of the male connector may be out of alignment because of its exposure to external effects such as vibration and physical contact during handling or storing especially for the tiny fragile contacts, so that the adjustment or re-alignment for mating is sometimes necessary in that situation.

It is noted that the shield 3 additionally provides the function of automatic alignment of every male contact during the mating process. The reason for this is that the shield 3 translated over and about the exposed male contacts prior to mating with the female contacts. This results in some benefits. One is to maintain the proper positioning of male contacts during and throughout the mating process. Another is to provide a support plane which is close to the interconnection between the male contact and the female contact. In the prior art, the male contact member projects from the insulator front surface in cantilever fashion, and the insertion force occurring in the interconnection between the male contact and the female contact is relatively significant to the male contact because the support point for the male contact is at its root spaced from the tip of the male contact where a contact bending moment is applied. In contrast, in the present invention, the shield offers an auxiliary floating support plane for the male contact spaced from its conventional support at its root during the mating process, the auxiliary floating support plane being closer to the point of interconnection between the male contact and the female contact, so that the bending moment is significantly reduced or eliminated. This factor allows for reducing contact pin strength requirements, and becomes more useful and important when the size of the connector and the contacts are designed to be smaller and smaller, as in miniaturized connectors.

It can therefore be understood that the floating shield 3 protects the male contacts against bending during handling due to eliminating exposure of the contact in the un-mated condition, therefore enabling a reduction of pin strength requirements of the contact, and allowing greater variation in male contact dimension. In other words, a designer may choose to use less expensive weaker material instead of expensive strong material, or form the contact by conventional stamping techniques instead of complicated and more expensive reinforcement forming. Also manufacturing tolerance may be enlarged because the shield will adjust and align the assembled male contacts in the connector. This provides an opportunity for the designer to develop a more compact structure while decreasing the cost of manufacturing.

In this embodiment, it can be understood that the shield 3 moves smoothly back and forth within the recess S. The reason is that the recess entrance presented by the flange 23 is conformable to the outer profile of the shield 3, and the post 34 is retained within the hole regardless of the condition of being mated or unmated.

Figure 4:
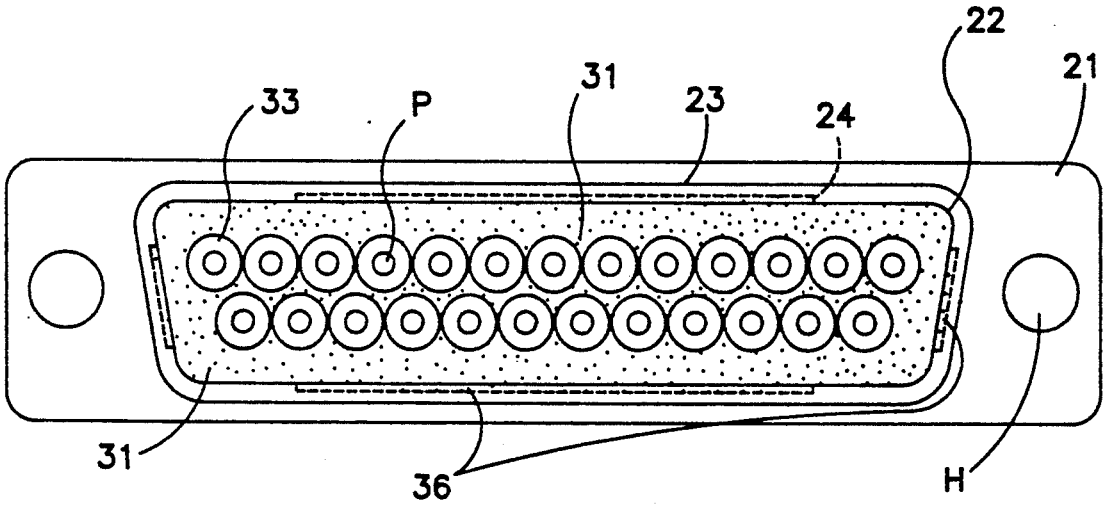
FIG. 4 is a front elevational view of the assembly of another embodiment.

In another alternate preferred embodiment, as shown in FIG. 4, the front surface 31 of the plastic floating shield 3 is metallized, which provides electrical static discharge (ESD) protection or shielding when the male connector is in an un-mated condition. The reason is that in the prior art, the exposed male contacts of the male connector mounted on a back panel of a computer, are easily touched by hands or other instruments whereby electrical static discharge (ESD) may damage internal computer components through the circuit connected with the contacts. In the present instance, the contacts are hidden or shielded behind the shield in the un-mated position, so there is less opportunity to reach the contacts but not to touch the shield. Once this happens, electrical static is drained from the metallized surface of the shield 3 through the shell 2 to ground, i.e. the computer case, without electrical invasion of internal components. This is also a significant advantage for application to other computer equipment.

While the invention has been described in connection with what is presently considered to be the most practical and preferred embodiments, it is to be understood that the invention is not limited to the disclosed embodiment but, on the contrary, is intended to cover various modifications and equivalent arrangements included within the spirit and scope of the appended claims. For example, the four outside corner relieved portions of the shield 3 may be omitted; the slot 37 may be omitted along with corresponding protrusion 13; even some or all side walls 32 of the shield 3 may be omitted if the groove 10 of the insulator 1 is omitted. The structure for moving the floating shield 3, including posts 34, springs 35 of the shield 3, and the holes 12 of the insulator 1 can be replaced by other means which provide the same function of resilient displacement of the shield 3 to the front portion of the connector to protect and align the contacts in the un-mated condition while accommodating inward displacement to open the recess to receive the corresponding portion of the female connector. To reach this function, the feasible way includes using a elastic member positioned between the shield and the insulator, or positioned between the shell and the shield, even using a compressible shield structure or material to achieve this effect. In appropriate circumstances, the resilient member behind the shield may be omitted. In those conditions, the shield is initially disposed on the front ends of the contact pins, and once moved to its inner portion by female connector, will not recover to the original position as in the un-mated condition. For this type connector, the shield is not reciprocable, but can still provide protection for the contacts before first use.

Having thus described the invention, what is believed to be new and novel, and sought to be protected by Letters Patent of the United States is as follows.

What is claimed is:

1. An electrical connector having a multiplicity of contact pins comprising:

an insulator having a plurality of passageways extending therethrough through each of which passageways a corresponding contact pin is inserted;

a metal shell having a recess opposite the front portion of the insulator and a plate having an opening defined therein, a flange extending from the edge of the opening, said recess being disposed between the flange and the insulator;

a shield member movable within said recess and having a plurality of apertures therethrough corresponding to the passageways of the insulator and slidably displaceable in said recess in relation to said contact pins;

at least one resilient means interposed between the shield member and the insulator;

said resilient means including a helical spring, a post projecting from said shield member and surrounded by one end of the helical spring, and a hole in said insulator receiving the other end of the spring whereby said spring biases said insulator and shield member in opposite directions;

said shield member including a base through which the apertures extend and from which the post extends, and at least one side wall extending from an edge of the base, a front surface of the floating shield member being metal to provide ESD protection;

a middle portion of the side wall of the shield member projecting outwardly, the flange and said recess having corresponding relieved portion extending in a direction to be conformable to the extended middle portion of said side wall, the corresponding relieved portion of the flange and recess terminating near the front end of the shell to form a step for stopping the further outward movement of the shield member;

a slot extending from the outer edge of the side wall inwardly of the shield member, and a corresponding protrusion being provided on the insulator whereby the protrusion enters the slot when the insulator and shield are assembled; and a fastening means to fixedly secure the shell on the insulator, said fastening means comprising two pairs of screw holes disposed on the shell and insulator individually to threadably receive screws attaching therethrough.

2. The electrical connector as described in claim 1, wherein the insulator has a groove to receive the side wall of the shield member.

3. The electrical connector as described in claim 2, wherein four wide walls extend form the circumferential edge of the base of the shield member, and the groove of the insulator encompassing the passageways portion extends inwardly from the front surface of the insulator.

4. An electrical connector with contact pin protection means comprising:

an insulator having a mounting flange surrounding a contact pin support body having a plurality of passageways therethrough;

a corresponding number of contact pins supported in the passageways of the support body;

a metal shell including a mounting plate having an opening positioned to register with the support body of the insulator, and including a flange portion extending from the periphery of the opening to form a recess disposed between the flange and the insulator;

a shield member movably mounted between said flange and said insulator rand arranged to close said recess and to enclose the contact pins in said recess when in an un-mated condition and to expose the contact pin when in a mated condition, wherein the front surface of the shield is metal and conductively contacts the metal shell in an unmated condition to form an electrical circuit path for ESD protection; and a fastening means securing the shell to the insulator.

5. The electrical connector as described in claim 4, wherein a step is formed on the front portion of the flange of the shell to limit the forward movement of the shield member.

6. The electrical connector as described in claim 5, wherein the shield member is mounted to move in a direction along the length of the contact.

7. The electrical connector as described in claim 6, wherein the shield member is provided with a plurality of apertures corresponding in number and position to the contact pins supported in said support body of the insulator.

8. The electrical connector as described in claim 5, wherein the shield member includes resilient member resiliently biasing the shield member abut against the step of the shell when in an un-mated condition.

9. The electrical connector as described in claim 7, wherein the shield member includes four side walls extending from the circumferential edge of the apertured support body, at least one post extending from the shield member, a helical spring surrounding said post, a groove surrounding the contact pin support body of the insulator and extending from the face of the insulator inwardly, and a hole positioned in the insulator to receive the spring and said post.

10. The electrical connector as described in claim 4, wherein the metalized surface of the shield member conductively contacts the front portion of the shell in an un-mated condition, and is disposed backwardly by insertion of a corresponding counterpart female connector member to expose the contact pins for mating the female contact sockets in a mated condition.

11. A multi-row and high density electrical male connector comprising: an insulator having a plurality of passageways therethrough supporting a corresponding plurality of elongated male contact pins therein; a metal shell including a mounting plate having an opening in the center portion thereof; a flange extending from the edge of the flange opening to form a recess between the flange and the insulator for receiving a complementary female connector; fastening means securing the shell to the insulator; a shield member mounted and moveable within the recess of said shell and having a plurality of apertures positioned therein in correspondence with said elongated contact pins, wherein the male contact pins are positioned within the recess and outer ends of said male contact pins are not beyond the recess, so that the shield member is in an outermost position within the recess to cover the elongated contact pins in an unmated condition, and is displaced backwardly within the recess to expose the male contact pins for mating the female contact pins in a mated condition.

12. A multi-row and high density electrical male connector with a floating shield structure, comprising: a housing including a contact pin support body having a plurality of passageways extending therethrough and a corresponding plurality of elongated male contact pins mounted in the corresponding passageways of the support body; a metal flange extending from the front of the housing opposite the support body to form a recess in front of the housing for receiving a complementary female connector; a floating shield structure within the recess and having a plurality of apertures in alignment with the elongated male contact pins for receiving the contact pins for slidable passage therethrough, a step formed on the interior of the recess to limit slidable movement of the shield member to within the recess; a spring connected to the shield member for resiliently displacing the shield member whereby the outer free ends of the elongated male contact pins are, within the recess, covered by the shield member when the connector is in an un-mated condition, and the floating shield member is displaced backwardly within the recess to expose the contact pins for mating when in a mated condition.

13. An multi-row and high density male electrical connector having a multiplicity of contact pins comprising:

an insulator including a contact pin support body having a plurality of passageways extending therethrough through each of which passageways a corresponding contact pin is inserted;

a metal shell having a recess for receiving a complementary female connector therein, said recess being opposite a front portion of the insulator whereby the contact pins are positioned within the recess, outer ends of the contact pins being adjacent an outer opening of the recess;

a shield member moveable within said recess and having a plurality of the insulator and slidably displaceable in said recess in relation to said contact pins;

a resilient means positioned on a peripheral portion of the contact pin support body and between the shield member and the insulator whereby the shield member is positioned in an outermost position within the recess to cover and protect the outer ends of the contact pins, and is moved rearwardly by insertion of a corresponding counterpart female connector member so as to expose the contact pins for mating female contact sockets in a mated condition.

14. The electrical connector as described in claim 13, wherein said resilient means includes a pair of helical springs, a pair of posts at opposite ends of the shield member rearwardly projecting therefrom and each surrounded by one end of one helical spring, and a pair of holes in said insulator receiving the other ends of said spring whereby said spring bias said insulator and shield member in opposite directions.

15. The electrical connector as described in claim 14, wherein the shield member includes a base through which the apertures extend and from which the posts extend, four side walls extending from a circumferential edge of the base of the shield member, and a circumferential groove of the insulator encompassing the passageways and extending inwardly from a front surface of the insulator to receive the side walls of the shield member.

16. The electrical connector as described in claim 15, wherein the connector further includes a fastening means to fixedly secure the shell to the insulator, said fastening means comprising two pairs of screw holes disposed on the shell and the insulator individually, and adapted to threadably receive a pair of screws therethrough.

* * * * *